US006749372B2

(12) United States Patent
Xie

(10) Patent No.: US 6,749,372 B2
(45) Date of Patent: Jun. 15, 2004

(54) UNDERGROUND SHELL-PILE CONTINUOUS WALL JOB PRACTICE AND ITS SPECIAL DRILL

(76) Inventor: Qing-Dao Xie, Rm. 502, 9-2, Hua Yuan Bei Cun, Wen Er Rd., Hangzhou City, Zhejiang (CN)

( * ) Notice: Subject to any disclaimer, the term of this patent is extended or adjusted under 35 U.S.C. 154(b) by 0 days.

(21) Appl. No.: 10/004,793

(22) Filed: Dec. 7, 2001

(65) Prior Publication Data

US 2002/0195274 A1 Dec. 26, 2002

(51) Int. Cl.[7] ..... E02D 5/18
(52) U.S. Cl. ..... 405/267; 405/239; 405/243
(58) Field of Search ..... 405/267, 266, 405/270, 249, 253, 256, 257, 233, 232, 231, 240–293

(56) References Cited

U.S. PATENT DOCUMENTS 910,252 A * 1/1909 Wolfley ..... 405/240
1,665,798 A * 4/1928 Sipe ..... 405/267
3,453,832 A * 7/1969 Rehmar ..... 405/241
3,779,025 A * 12/1973 Godley et al. ..... 405/233
5,240,348 A * 8/1993 Breaux ..... 405/267
5,490,743 A * 2/1996 Vales ..... 405/267
5,800,096 A * 9/1998 Barrow ..... 405/267
5,823,276 A * 10/1998 Beck, III ..... 405/239
6,048,137 A * 4/2000 Beck, III ..... 405/233
6,189,630 B1 * 2/2001 Beck, III ..... 175/96

* cited by examiner

*Primary Examiner*—Frederick L. Lagman
(74) *Attorney, Agent, or Firm*—Charles E. Baxley

(57) ABSTRACT

An underground shell-pile continuous wall job practice, which utilizes a special drill for constructing a continuous wall underground, is initiated by sinking two coupled special drills connected together by male and female connectors fixed on the main trunks of them respectively. Then, the first special drill is withdrawn while simultaneously pouring concrete into it until the first shell pile is finished. The process of sinking special drills and withdrawing and pouring concrete to build shell piles is repeated until the whole continuous wall is finished. In this way, building an underground continuous wall is rapid, economic and effective. The special drill has a simple structure which provides for simultaneous insertion and draining of displaced soil, thereby reducing the sinking drag force. Thus, earthmoving normally required to build underground walls is reduced greatly.

6 Claims, 2 Drawing Sheets

UNDERGROUND SHELL-PILE CONTINUOUS WALL JOB PRACTICE AND ITS SPECIAL DRILL

BACKGROUND OF THE INVENTION

1. Field of the Invention

The present invention relates to an underground continuous wall job practice applying into soft base anti-seepage, and meanwhile involves to its special drill.

2. Description of Prior Art

In accordance with the conventional underground continuous walls, most of them are used for anti-seeping in foundation of dams, basements, harbor and sluice gate base or both banks of rivers and so on. The job practice is to excavate a trench in the job location firstly, then to pour concrete to construct a continuous proof-water wall in the pit. In this way, too much earthmoving has to be processed in the construction procedure, and too much the concrete is used, the time limit of project is too long and the production cost is very high. And once encountering with groundwater or complex geological structure, the sidewalls of said trench couldn't be kept in standing so that the construction difficult is increased. If utilizing steel sheet wall or prefabricated concrete plate pile and so on, the investment cost will double and redouble, the anti-seepage effect is also not good as expected. A rapid construction method of concrete shell pile in soft basement and its special drill disclosed in Chinese Patent No.98113070.4 provides a way of constructing a single pile, but not constructing a continuous wall underground conveniently and economically.

OBJECTS AND SUMMARY OF THE INVENTION

It is therefore a main object of the present invention to provide a rapid and economic construction way to build an underground shell-pile continuous wall to have better expected anti-seeping effect, meanwhile to provide a special drill for carrying out this job practice.

This object is achieved by a job-practice adapting cluster of shell-piles to build an underground wall. Follows steps carry out said job practice:

1. Attach a circular pile shoe having cutting faces on the bottom end of the barrel core space of each special-drill building cluster of shell-piles.
2. Locate the first special drill on the job position vertically standing on said pile shoe, and exert pressure on the vibrating head at the tip end of said special drill to press said special drill sinking into the ground to get the desired depth in the soft soil layer, the expelled soil is driven out along the inside wall of inner draining hole of said special drill.
3. Locate and connect the second special drill with the first special drill by coupling the male connector of the second special drill to the female connector of the first special drill, and process the second special drill as described in step 2 to sink into the desired depth.
4. Pour the concrete from the loading hopper of the first special drill, vibrate said special drill as pouring, and withdraw up said special drill simultaneously to depart said pile shoe from the drill trunk until the first special drill is dragged out from the ground completely to build the first shell pile.
5. Put on a new pile shoe on the used first special drill or prepare the third special drill, repeat the step 3 to locate and connect the new special drill to the second special drill, and sink into the designed depth.
6. Repeat the step 4 to withdraw the second special drill, meanwhile build the second clustering shell pile with the first one.
7. In the same way, repeat the circular steps until to build enough many shell-piles to construct an underground continuous wall.

For archiving above-described job practice, said special drill is designed to comprise of a pair of centered an inner sleeve and an outer sleeve, a barrel core space formed between the outside wall of said inner sleeve and the inside wall of said outer sleeve, and a circular pile shoe fitted into the ring opening at the bottom side of said barrel core space, and a flange retained on the top ends of said inner and outer sleeves, and a vibrating head attached on the top side of said flange; said vibrating head has a draining hole connecting to the inner cave of said inner sleeve, and a loading hopper set upon the outside wall of said outer sleeve approaching the top end connecting to the barrel core space, and a pair of male connecter and female connector are fixed on the outside wall of said outer sleeve axially and parallelly, and their including angle to the central axial should be not less than 60°.

Due to applying this job practice, less earthmoving is processed during the construction procedure, less concrete is needed, it can be used for pouring and building an underground continuous shell-pile wall in the real time at the work site, so that the time limit of project is shortcut, and the cost is reduced, and a better anti-seepage effect is archived.

Said special drill provided in the present invention has a simple structure; by rapid connecting and locating male and female connectors fixed on said special drill, conjunction of shell-pile is became into easy. Draining the expelled soil can be processed as sinking the special drill so that the sinking drag turbine is less, and earthmoving is less too.

DETAILED DESCRIPTION OF PREFERRED EMBODIMENTS

Figure 1:
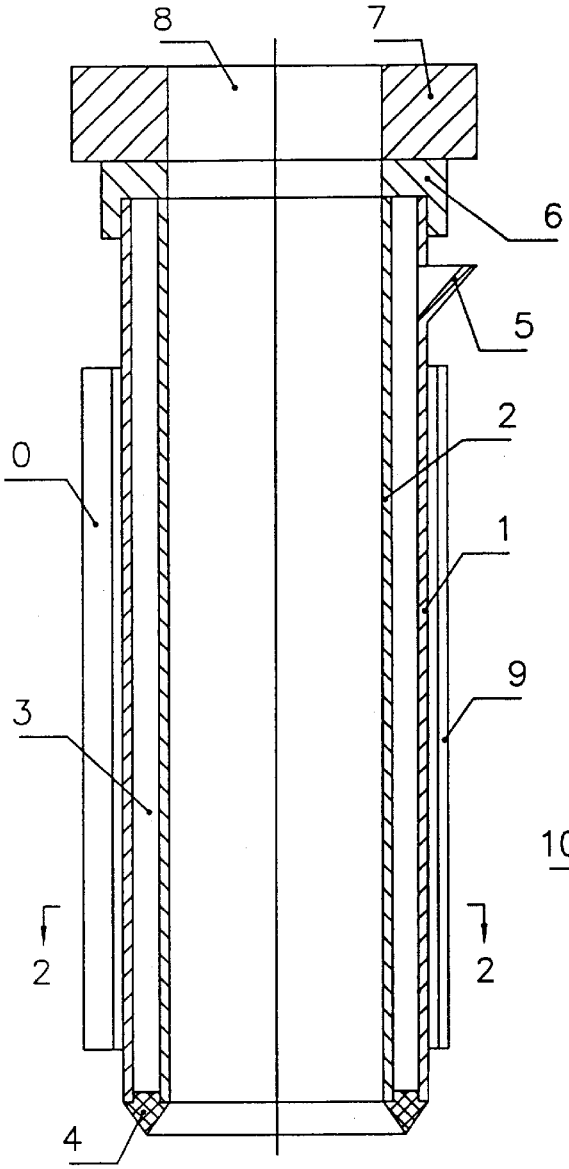
FIG. 1 is a cross-section view showing the combination of the special drill of the present invention.
Figure 2:
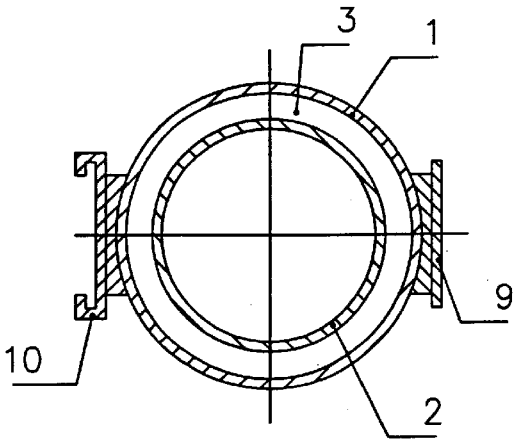
FIG. 2 is a cross-section view showing the section line 2—2 line in FIG. 1.
Figure 3:
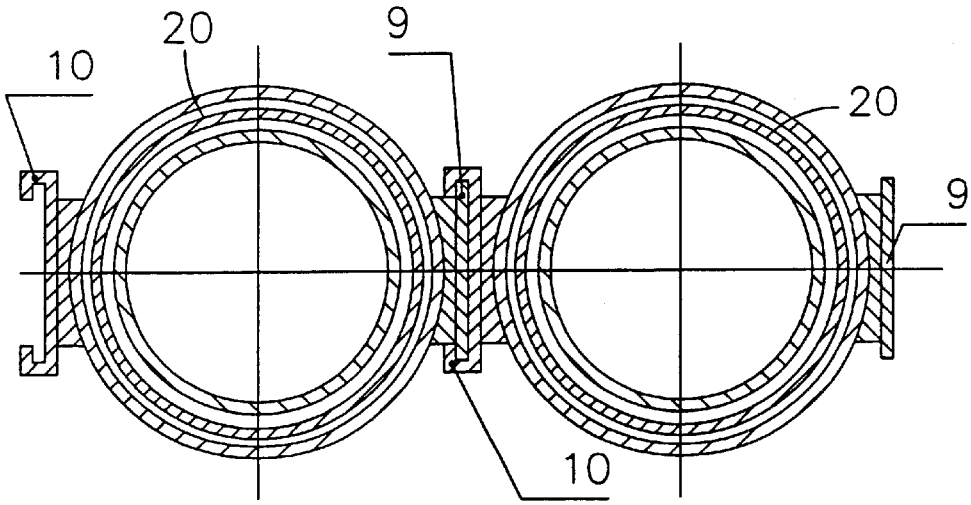
FIG. 3 is a cross-section view showing the connection of male and female connectors of the present invention.
Figure 4:
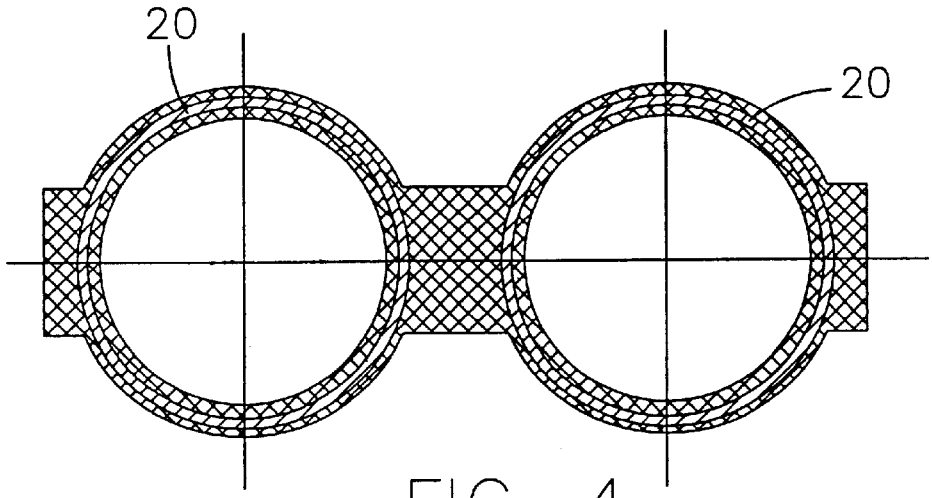
FIG. 4 is a cross-section view showing section of the underground continuous shell-pile wall of the present invention.

The crux of the job practice of the present invention is to utilize special drill with male and female connectors to build an integrated underground continuous shell-pile wall; the methods are as follows steps:

1. Attach a circular pile shoe 4 having cutting faces on the bottom end of the barrel core space 3 of each special-drill building cluster of shell-piles.
2. Locate the first special drill on the job position vertically standing on said pile shoe, and exert pressure on the vibrating head 7 at the tip end of said special drill to press said special drill sinking into the ground to get the desired depth in the soft soil layer, the expelled soil is driven out along the inside wall of inner draining hole 8 of said special drill.
3. Locate and connect the second special drill with the first special drill by coupling the male connector 9 of the second special drill to the female connector 10 of the first special drill, and process the second special drill as described in step 2 to sink into the desired depth.

4. Pour the concrete from the loading hopper 5 of the first special drill, vibrate said special drill as pouring, and withdraw up said special drill simultaneously to depart said pile shoe 4 from the drill trunk 3 until the first special drill is dragged out from the ground completely to build the first shell pile.
5. Put on a new pile shoe 4 on the used first special drill or prepare the third special drill, repeat the step 3 to locate and connect the new special drill to the second special drill, and sink into the designed depth.
6. Repeat the step 4 to withdraw the second special drill, meanwhile build the second clustering shell pile with the first one.
7. In the same way, repeat the circular steps until to build enough many shell-piles to construct an underground continuous wall.

In the job practicing, sinking the special drill can apply a static pressure, but adapting a vibrating pressure will obtain a rapider and better effect. As dragging out, static force has to overcome greater friction force, but under vibrating state, a little dragging force will be commanded, meanwhile the poured concrete is swung into dense. The expelled soil can be driven out from the inner cave of inside sleeve 2 without refilling soil into said inner cave, so that the working capacity is reduced. If need to build steel concrete shell piles, a steel cage 20 or a tendon can be located into the barrel core space 3 before attaching said pile shoe at the bottom open end of said special drill, so that said steel stage 20 and said pile shoe become a part of shell pile modeled by poured concrete.

For archiving above-described job practice, said special drill is designed to comprise of a pair of centered an inner sleeve 2 and an outer sleeve 1, a barrel core space 3 formed between the outside wall of said inner sleeve 2 and the inside wall of said outer sleeve 1, and a circular pile shoe 4 fitted into the ring opening at the bottom side of said barrel core space 3, and a flange 6 retained on the top ends of said inner and outer sleeves 2 and 1, and a vibrating head 7 attached on the top side of said flange 6; said vibrating head 7 has a draining hole 8 connecting to the inner cave of said inner sleeve 2, and a loading hopper 5 set upon the outside wall of said outer sleeve 1 approaching the top end connecting to the barrel core space, and a pair of a male connecter 9 and a female connector 10 are fixed on the outside wall of said outer sleeve 1 axially and parallelly, and their including angle to the central axial should be not less than 60°.

Said mating pile shoe 4 is a prefabricated concrete part in common, and is shaped into ring with cutting faces. If the including angle between said male connector 9 and said female connector 10 to the central axial is less than 60°, the shell piles will appear overlapping state. According to the corner or curve of the underground continuous wall, the central including angle can be 90°, or 120° and so on. In regard to a straight line continuous wall, the central including angle between said male connector 9 and said female connector 10, just as both of them are located on the opposite sides of said outer sleeve 1. In this embodiment, said male connector 9 is a flat strip section, and said female connector 10 is a coordinating sliding channel section. Actually they can be selected in other shape sections or other guide connecting devices just working as coupling and locating tow adjacent special drills in sliding fitting, further to be used to build cluster of shell piles. Said draining hole 8 of said vibrating head 7 can drain the expelled soil to side, but draining soil upward will get less drag force.

I claim:

1. A method for forming an underground shell-pile continuous wall, comprising the steps of:

a) attaching a circular pile shoe having cutting faces on the bottom end of a barrel core space of each special-drill building cluster of shell-piles;

b) locating a first special drill on the job position vertically standing on said pile shoe, and exert pressure on a vibrating head at the tip end of said special drill to press said special drill sinking into the ground to get a desired depth in the soft soil layer, the expelled soil is driven out along the inside wall of inner draining hole of said first special drill;

c) locating and connecting a second special drill with the first special drill by coupling a male connector of the second special drill to a female connector of the first special drill, and process the second special drill as described in step b to sink into the desired depth;

d) pouring concrete from a loading hopper of the first special drill, vibrate said special drill as pouring, and withdraw up said special drill simultaneously to depart said pile shoe from the bottom end of said barrel core space until the first special drill is dragged out from the ground completely to build a first shell pile;

e) attaching a new pile shoe on the used first special drill or prepare a third special drill, repeat the step c to locate and connect the new special drill to the second special drill, and sink into the desired depth;

f) repeating step d to withdraw the second special drill to form a second clustering shell pile in contact with the first shell pile; and g) repeating steps c through f until the underground shell-pile continuous wall is completed.

2. The method for forming an underground shell-pile continuous wall as in claim 1, further comprising the step of:

positioning a steel cage or a tendon into the barrel core space before attaching said pile shoe at the bottom open end of each of said special drills, so that said steel cage and said pile shoe become a part of shell pile molded by poured concrete.

3. A special drill for use in forming an underground shell-pile continuous wall, comprising:

an inner sleeve and a coaxial outer sleeve, wherein a barrel core space is formed between the outside all of said inner sleeve and the inside wall of said outer sleeve;

an annular pile shoe fitted into an annular opening at the bottom side of said barrel core space;

a flange retained on the top ends of said inner and outer sleeves;

a vibrating head attached on the top side of said flange, said vibrating head having a draining hole connecting to an inner cavity of said inner sleeve;

a loading hopper set upon the outside wall of said outer sleeve approaching the top end connecting to the barrel core space; and a male connector and a female connector each longitudinally extending on the outside wall of said outer sleeve such that a circumferential separation angle between said male connector and said female connector is not less than 60°.

4. The special drill as claimed in claim 3, wherein said male and female connectors are located on opposite sides of said outer sleeve such that said circumferential separation angle is 180°.

5. The special drill as claimed in claim 3, wherein said vibrating head has a draining hole opening upward.

6. The special drill as claimed in claim 4, wherein said vibrating head has a draining hole opening upward.

* * * * *